United States Patent [19]

Eaton

[11] Patent Number: 4,638,558

[45] Date of Patent: Jan. 27, 1987

[54] WIRE PROCESSING METHOD AND APPARATUS

[75] Inventor: Homer L. Eaton, Leucadia, Calif.

[73] Assignee: MTS Vektronics Corporation, Carlsbad, Calif.

[21] Appl. No.: 615,933

[22] Filed: May 31, 1984

[51] Int. Cl.[4] ..... H01R 43/04; B21F 00/00; B65G 15/14

[52] U.S. Cl. ..... 29/861; 140/1; 140/102; 29/33 F; 29/564.1; 29/753; 198/626; 198/628; 226/44; 226/45; 242/129

[58] Field of Search ..... 140/1, 102; 29/33 F, 29/861, 753, 759, 564.1; 81/9.51; 198/626, 628; 226/44, 45, 42; 242/129, 107.1, 107.11, 107.13

[56] References Cited

U.S. PATENT DOCUMENTS

| | | | |
|---|---|---|---|
| 1,756,771 | 4/1930 | Watson et al. . | |
| 1,850,315 | 3/1932 | Crocker . | |
| 2,029,975 | 2/1936 | Winchester . | |
| 2,285,654 | 6/1942 | Hanna et al. | 242/45 |
| 2,463,009 | 3/1949 | Woodland et al. | 242/118 |
| 2,517,866 | 8/1950 | Glahn | 242/137 |
| 2,533,495 | 12/1950 | Moffett | 242/96 |
| 2,533,731 | 12/1950 | Gomberg . | |
| 2,620,997 | 12/1952 | Lyon | 242/128 |
| 2,661,773 | 12/1953 | Kretzschmar | 139/97 |
| 2,824,709 | 2/1958 | Macy | 242/135 |
| 2,972,451 | 2/1961 | Pfeffer, Jr. | 242/75.3 |
| 3,339,755 | 9/1967 | Schwalm | 140/1 X |
| 3,352,412 | 11/1967 | Draving et al. | 206/59 |
| 3,727,858 | 4/1973 | Cornwell et al. | 242/129 |
| 3,819,847 | 6/1974 | Charles | 174/37 |
| 3,853,285 | 12/1974 | Woodring | 242/107.11 |
| 3,964,142 | 6/1976 | Ogawa et al. | 29/33 M |
| 3,973,600 | 8/1976 | Choromokos | 140/1 |
| 4,011,976 | 3/1977 | Greer . | |
| 4,077,118 | 3/1978 | McKeever | 29/753 X |
| 4,107,838 | 8/1978 | Keen et al. | 29/564.1 X |
| 4,165,768 | 8/1979 | Gudmestad | 140/140 |
| 4,238,981 | 12/1980 | Karl | 81/9.51 X |
| 4,249,433 | 2/1981 | Hara | 81/9.51 |
| 4,275,619 | 6/1981 | Shimizu | 140/1 X |
| 4,375,229 | 3/1983 | Mikami et al. | 29/753 X |
| 4,502,586 | 3/1985 | Dusel et al. | 29/759 X |

FOREIGN PATENT DOCUMENTS

| | | | |
|---|---|---|---|
| 2607950 | 9/1977 | Fed. Rep. of Germany | 242/107.13 |
| 1426975 | 3/1976 | United Kingdom | 242/107.1 |

*Primary Examiner*—Howard N. Goldberg
*Assistant Examiner*—Carl J. Arbes
*Attorney, Agent, or Firm*—Gausewitz, Carr & Rothenberg

[57] ABSTRACT

Electrically conductive wires, to be connected to multiple terminal connectors and assembled in a wire harness, are prepared for harness assembly by winding individual wires on a reel, cutting each wire to length with both ends of the wire protruding in aligned but opposite directions from the reel, transporting the reel and wound wire by grasping the protruding ends in conveyor mounted clamps, and presenting the wire ends to stripping and terminal attachment machines as the conveyor carries the reel mounted wire. Each piece of wire remains on its individual reel for storage and handling of stacks of reels, and for manipulation of the wire during its placement in a wire harness.

41 Claims, 20 Drawing Figures

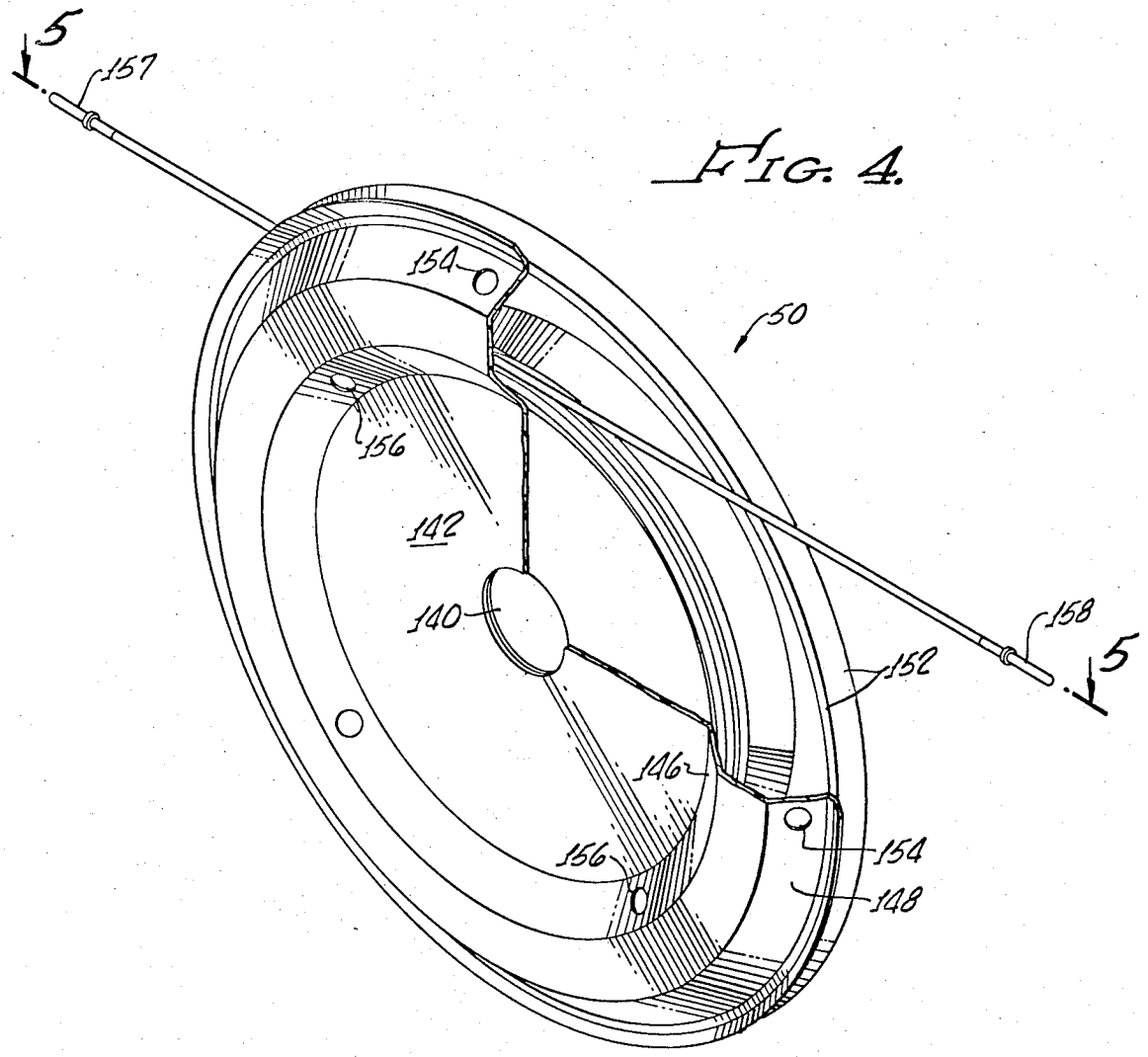
FIG. 4.
FIG. 5.
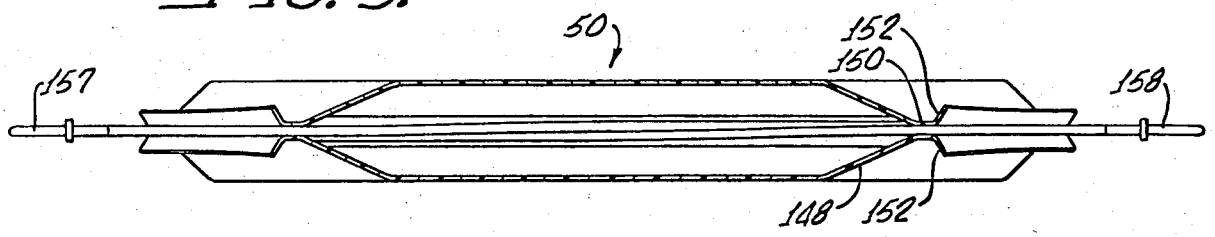

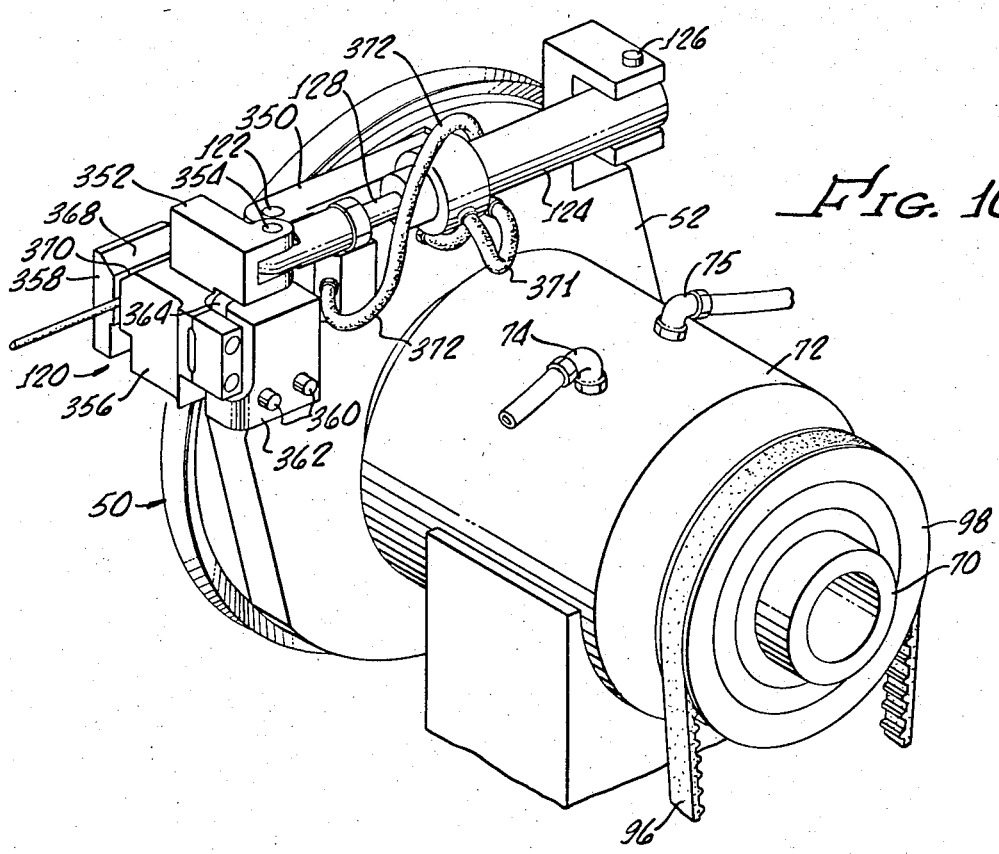
FIG. 10.
FIG. 11.
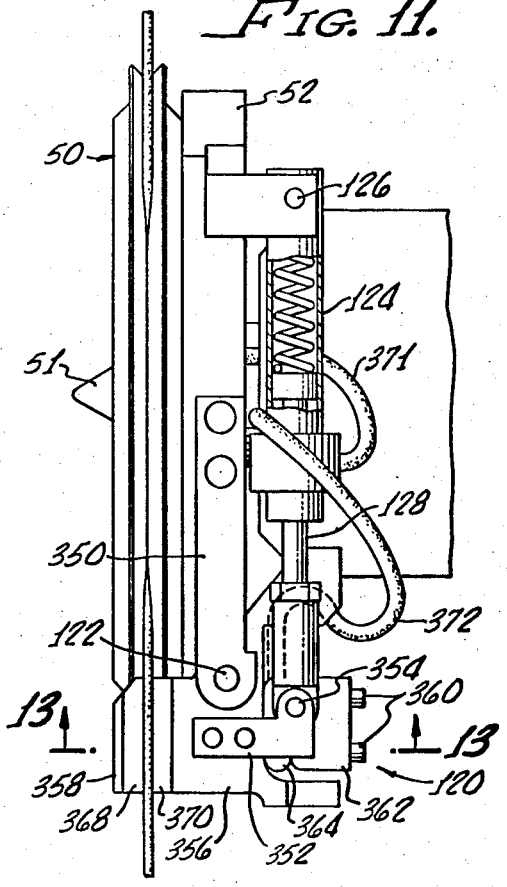
FIG. 12.
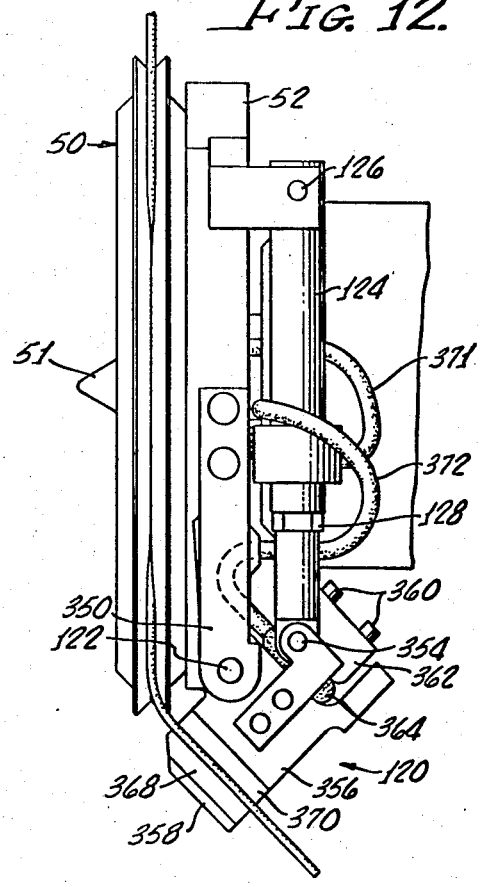

FIG. 18.
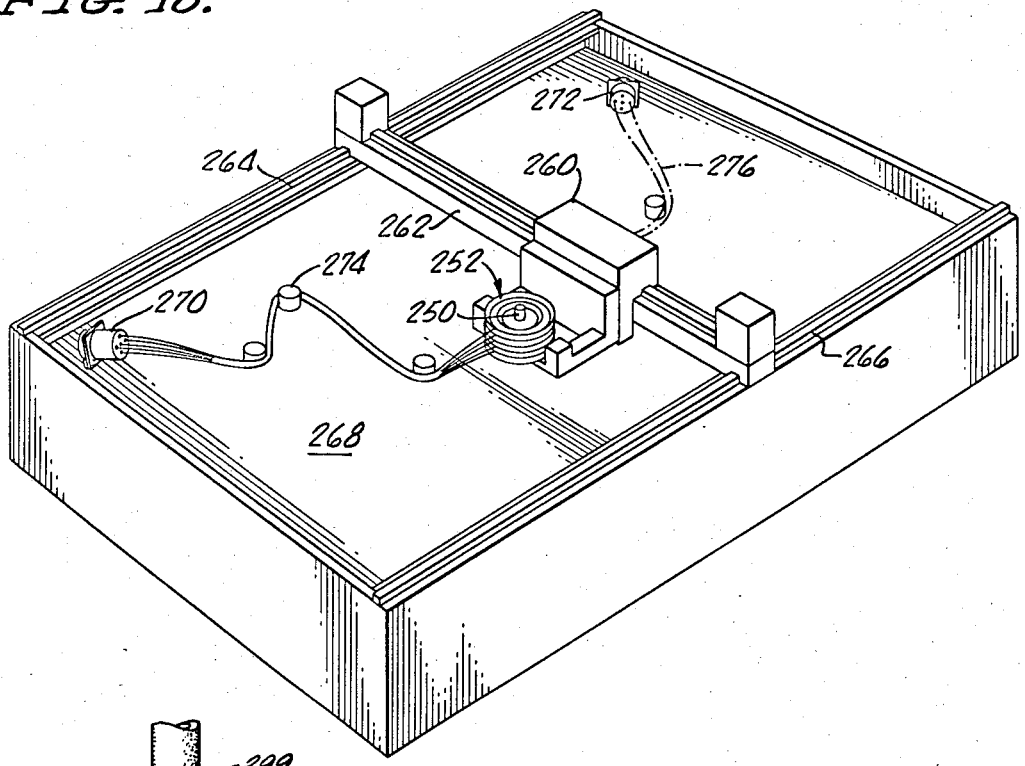
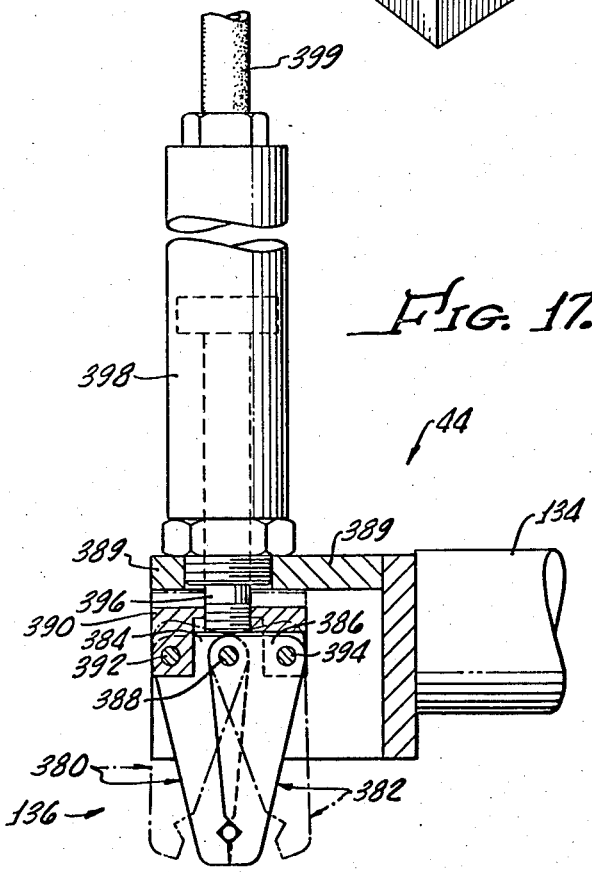
FIG. 17.
FIG. 13.
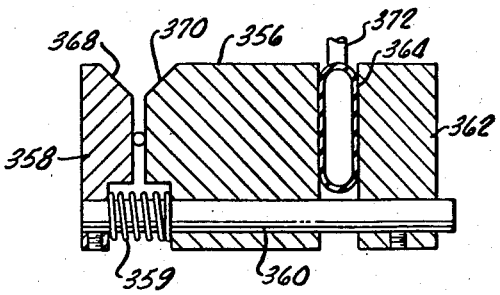

FIG. 19.
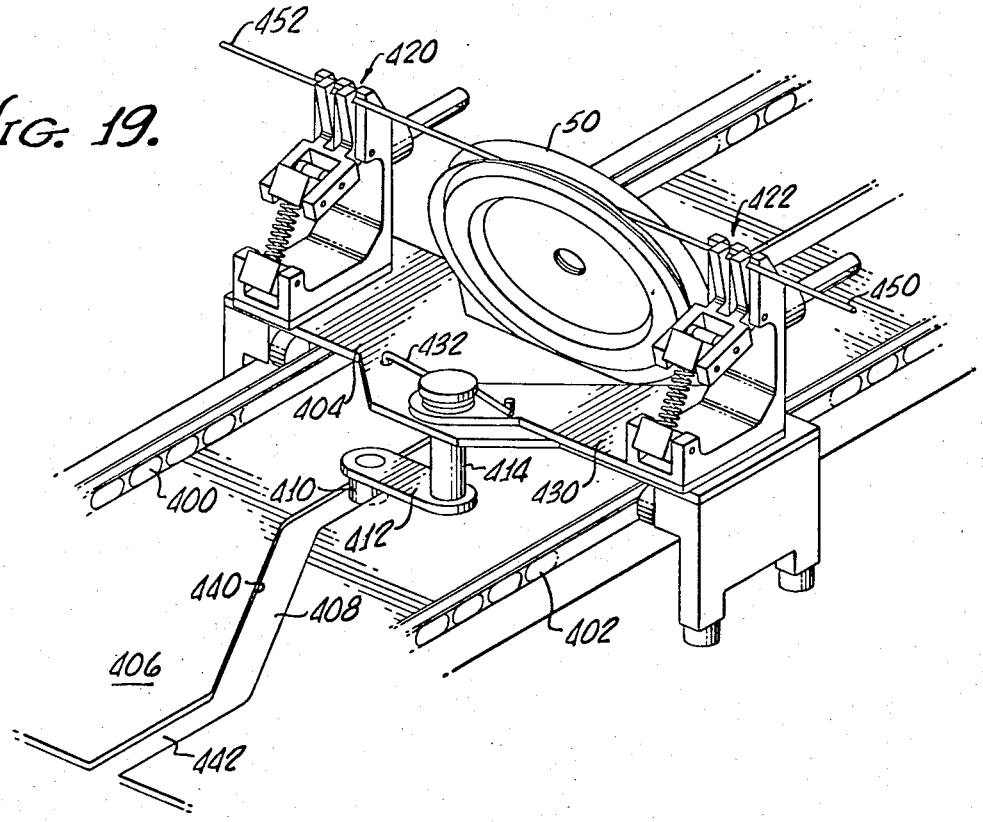
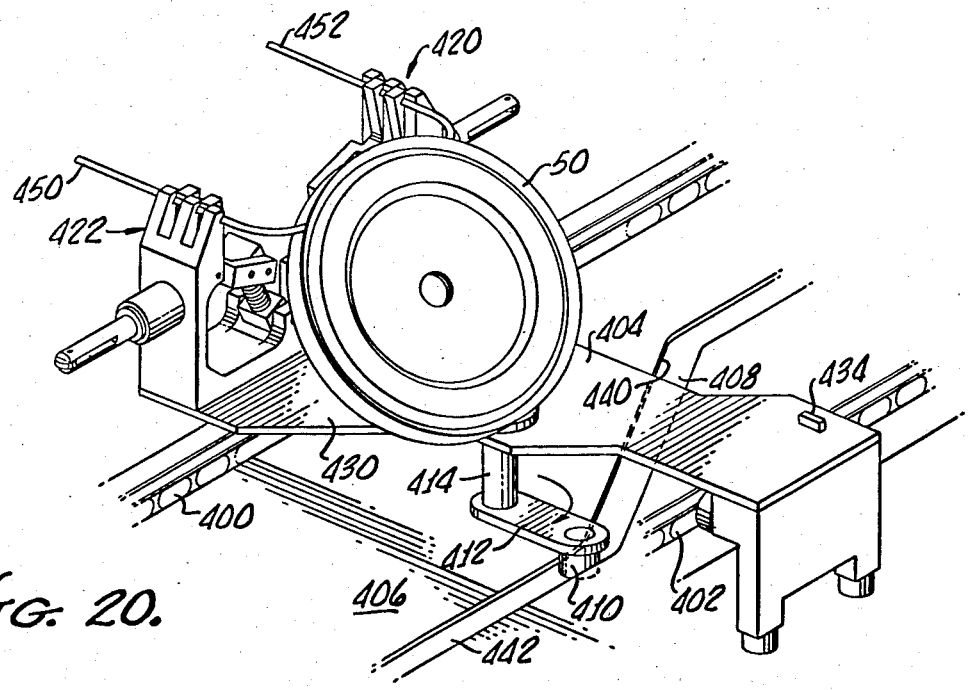
FIG. 20.

WIRE PROCESSING METHOD AND APPARATUS

BACKGROUND OF THE INVENTION

The present invention relates to methods and apparatus for processing and handling electrically conductive insulated wire, and more particularly concerns improved handling and transport for wire end processing.

As commercial and military aircraft and automobiles make increasing use of electrical and electronic devices, ever greater numbers of electrical wires and connections are required. Electrical signals are generally carried in such vehicles by wire harnesses comprising bundles of insulated wires routed between different electrical connectors. Such harnesses are commonly assembled prior to installation. For assembly of a wire harness, lengths of insulated wire are cut, ends stripped, and terminal pins secured to the wire ends. Thereafter, individual lengths of wire are transported to an assembly area where the harness is assembled by inserting the terminal pins into multi-pin connectors and laying the wires in bundles extending from one connector to another.

To increase speed of preparation of large numbers of individual wires for use in a wire harness, Artos Engineering Company has manufactured machines for high speed production of sets of identically sized insulated wires which cut the wire, strip ends of a cut wire, and fix terminals thereon. Such machines employ straight lengths of wire stretched from one side to the other of a conveyor table and transported past end finishing stations. The machines are of variable width so as to accommodate wires of different lengths. However, to change from the end finishing of a wire of one length to end finishing of a wire of another length requires the operation to be stopped, and the machine width to be adjusted to accommodate the new wire length. In any event, such machines are capable of handling wires no longer than the maximum machine dimensions, which may be in the order of eight to ten feet, for example, but cannot handle longer pieces of wire. Lengths in the order of twenty feet to well over one hundred feet cannot be handled by prior art machines.

Because prior automatic end processing machines must be adjusted in length for different sized wires, they are readily adapted primarily to preparation of large numbers of wires of exactly the same size. Such machines are not satisfactory, nor economically feasible, where only a few pieces of any given length are required, or where many different wire lengths must be processed.

Automatic end finishing is not presently employed for longer lengths of wire. According to prior practice, the longer wire section is marked as desired, cut to a size larger than needed, and placed in a loose coil. The operator then manually ties the coil and manually places on end first in a wire stripper and then in a terminal attaching machine. Thereafter, the tied wire is transported to a routing table where the finished end is inserted into a connector, the coil untied and passed along the desired wire harness path until the accurate length of the oversized precut wire is determined, so that the second end of the wire may be then precisely cut. This end is then stripped, a terminal pin inserted, and a connection made. The excessive amount of manual handling and processing of such wire lengths is costly, time consuming and subject to increased probability of human error.

Accordingly, it is an object of the present invention to process and handle wire in a manner that avoids, or minimizes, above-mentioned problems.

SUMMARY OF THE INVENTION

In carrying out principles of the present invention, in accordance with a preferred embodiment thereof, a length of wire is wound upon a reel with at least the first end of the wire projecting from the reel. The projecting wire end is grasped to transport reel and wire to one or more end processing stations while the wire remains on the reel. More specifically, the wire is wound on the reel so as to cause both ends of the precut wire to project from the reel in substantially opposite directions, so that both ends of the wire may be grasped by conveyor clamps to carry the reel with the wire thereon to end processing stations. According to a feature of the invention, wire of predetermined length is wound upon a reel by feeding wire from a supply station to a storage station, at an input rate, and withdrawing wire, at an output rate, from the storage station to the work station. The magnitudes of both input and output rates are controlled by sensing the amount of wire in the storage station so that the two rates need not be synchronized even though high rates can be used. Feeding of material into the storage station is stopped when a predetermined length of wire has been measured and withdrawal of the wire from the storage station is stopped when the amount of material in the storage station decreases to a predetermined amount. With this arrangement, the wire may be cut to precise length at a point adjacent the reel and wire measurement may take place ahead of the reel so that identification marking of the wire may be accomplished. The relatively remote measuring station need not make any cutpoint mark on the wire.

BRIEF DESCRIPTION OF DRAWINGS

FIG. 4 is a perspective view of a reel having a length of wire wound thereon;

FIG. 5 is a section taken on lines 5—5 of FIG. 4;

FIG. 10 is a perspective view of the reel holding chuck and chuck mounted clamp;

FIGS. 11 and 12 are top views of the chuck clamp in different positions;

FIG. 13 is a section of the chuck clamp taken on line 13—13 of FIG. 12;

FIG. 17 illustrates the load arm clamp;

FIG. 18 illustrates the assembly of a harness using a plurality of reels of wire processed according to the present invention; and FIGS. 19 and 20 show a modification of the conveyor transport arrangement.

DETAILED DESCRIPTION OF THE INVENTION

Figure 1:
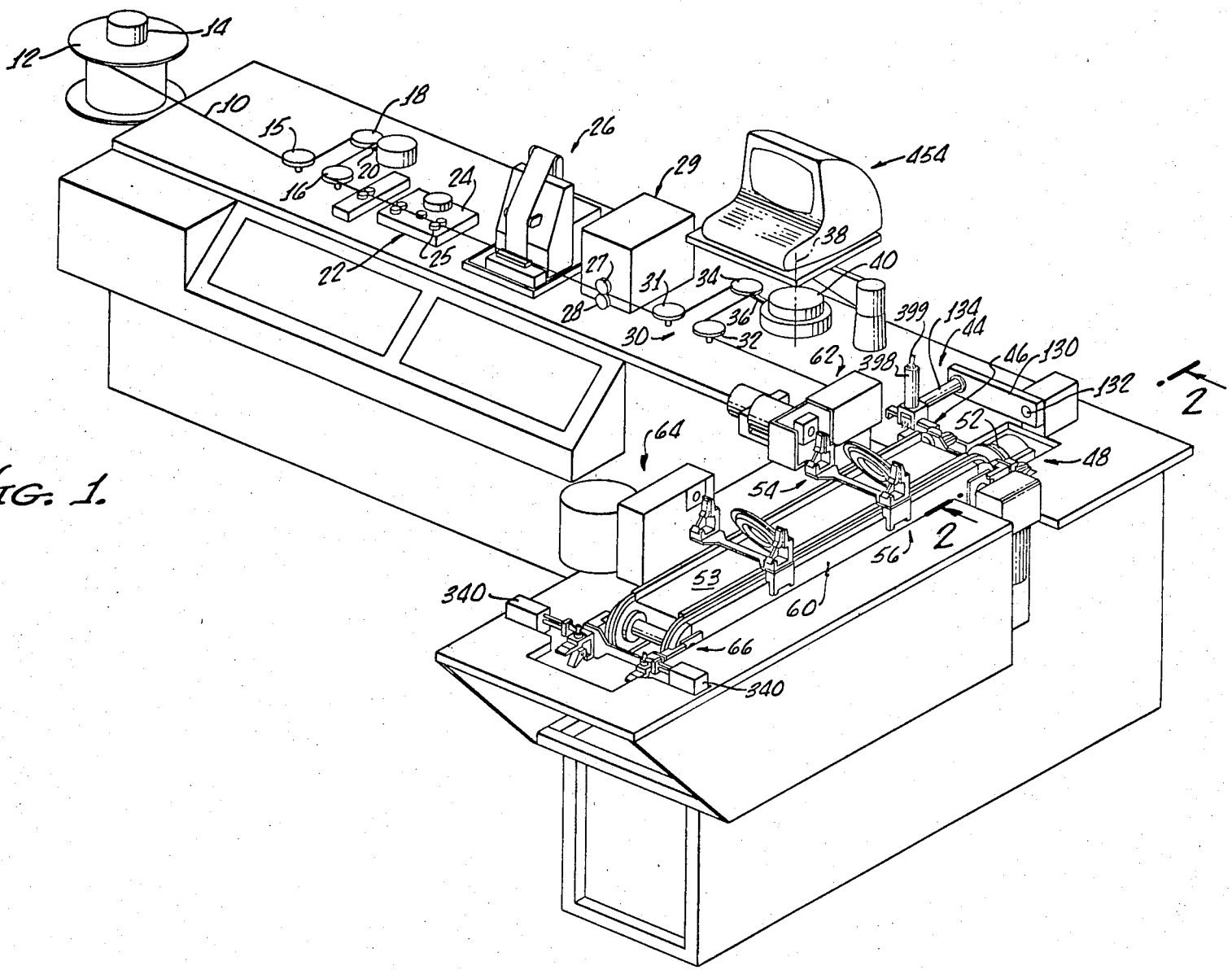
FIG. 1 is an overall perspective view of apparatus embodying principles of the present invention.

An example of an apparatus embodying principles of the present invention is illustrated in FIG. 1. Wire 10 is drawn from a supply spool 12, which may be driven by a motor 14, and fed through a storage loop, comprising idler pulleys 15, 16 and a movable pulley 18 carried on a swinging arm 20 that is spring-urged in a clockwise direction. Wire passes from the storage loops 15, 16, 18 through a wire straightener and measuring station 22, including measuring rollers 24, 25. The rollers 24, 25 are connected to an encoder (not shown in FIG. 1) that produces electrical signals indicating the length of wire passing the rollers. From station 22, the wire passes through a marker or printer 26, which may be an ink jet printer or wire marker, such as shown in U.S. Pat. No. 4,029,006, and which marks the wire for identification. From the printer, the wire passes between a pair of drive wheels 27, 28 at a drive station 29. The drive wheels tightly grasp the wire and pull it past the printer at a rate controlled in a manner to be described below. From the drive station, the wire passes through a wire storage station or controlling slack loop 30, including fixedly positioned idler pulleys 31, 32 and a swinging pulley 34 mounted on the end of a swing arm 36 that is pivoted for rotation about an axis 38, and urged in a clockwise direction by a spring (not shown in FIG. 1). A slack loop encoder 40, mounted on axis 38, produces output signals indicating the angular position of the slack loop arm 36 and, therefore, of the amount of wire stored in the loop 30.

From the slack loop, the wire is drawn past a load arm 44, and past a cutting station 46, to a winding station 48 located close to the cutting station. At the winding station, the wire is wound upon a reel 50 (FIGS. 3, 4, 5) that is secured to the conical hub 51 of a vacuum chuck 52, and initially loaded with the leading end of the wire by means of the load arm 44. The reel is capable of holding wire wound thereon in any length, from very short pieces to lengths of one or more hundreds of feet.

The wire is wound upon the reel, with both leading and trailing ends of the cut wire projecting from the reel in aligned opposite directions, so that pairs of opposed transport clamps 54, 56 may grasp the oppositely projecting ends of the wire, after it is wound on the reel, and tilt the upper portion of the reel forwardly to pull the reel off the tapered end of the chuck hub after the reel-holding vacuum of the chuck face is released. The reel, with the wire wound thereon, is transported by the clamps 54, 56 along the length of a conveyor 60, upon which the transport clamps are mounted. Positioned along at least one side of the conveyor 60 is a series of wire end processing stations, such as a conventional stripper 62, at which the projecting end of the wire is stripped of its insulation, and a terminal attachment station 64, at which a conventional terminal pin is mounted to the bare end of the wire. Additional end processing stations (not shown), including a stripper station and a terminal attachment station, are positioned on the opposite side of the conveyor, directly opposed to the stripper and terminal stations illustrated, so that both ends of the wire, projecting in opposite directions from the reel and transport clamps, may be processed together. As the conveyor, with the now end finished wire and reel, reaches its discharge end 66, the transport clamps release the wire, whereby the reel and wire drop into a container or other device (not shown in FIG. 1) for storage or further handling, as deemed necessary or desirable. Alternatively, an automatic unloading arm (not shown) may be provided to grasp the reel, as the wire ends are released from the transport clamps, and to position the reel for subsequent handling or use in the harness assembly.

With wire ends grasped in the transport clamps, a reel of the size employed in a presently preferred embodiment, has its lower edge resting upon and sliding along a fixed flat horizontal upper surface 53 of the conveyor. This avoids supporting the entire weight of reel and wound wire from the wire ends that are grasped in the transport clamp during most of the processing operation. If deemed necessary or desirable, there may be provided additional means on the moving conveyor to grasp or hold the lower portion of the reel in a desired orientation so as to facilitate use of an automatic arm, or the like, to pick up the reel and wire, after ends are finished, for transfer to a further operating station.

Figure 15:
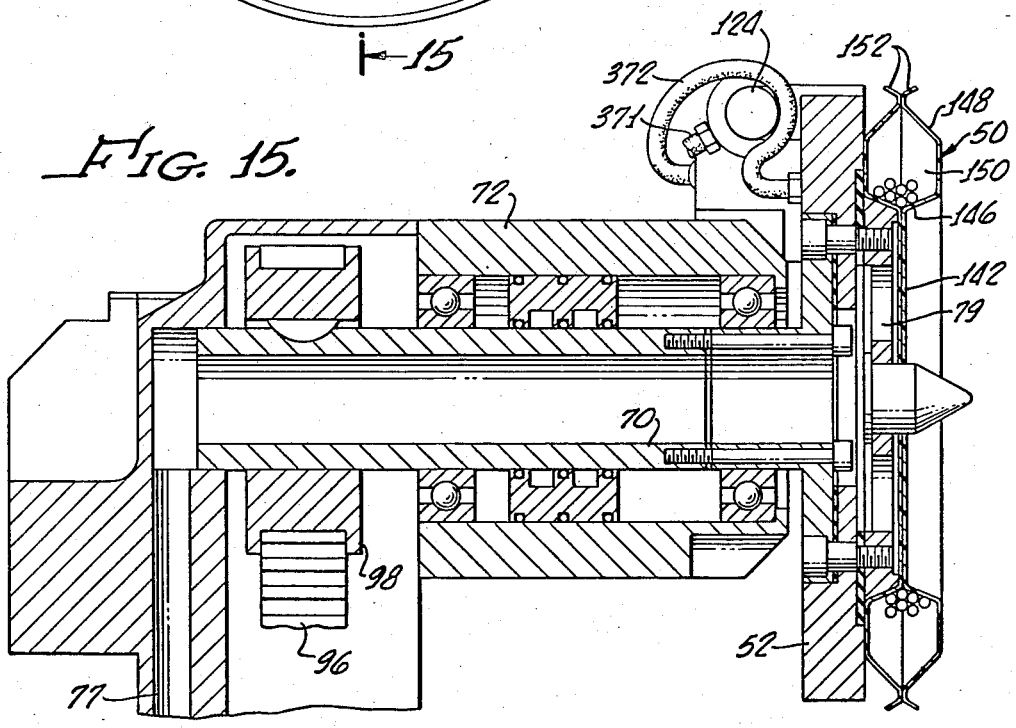
FIGS. 15 and 16 are sections taken on lines 15—15 and 16—16 of FIG. 15.

Chuck 52 (FIGS. 2, 3, 11, 12, 13, 15, 16, 17) is mounted on a hollow shaft 70 that is journaled in a housing 72 having pressure fittings 74, 75 (FIGS. 10, 16), for purposes to be described below. Vacuum is applied to the face of the chuck via a vacuum hose 76 (FIG. 2), a vacuum manifold 77, hollow shaft 70, and chuck passages 79 (FIG. 15). This enables vacuum attachment of the reel 50 to the chuck face. Housing 72 is fixedly attached to the end of a right angle drive housing having a normally upright arm 78 fixed to a horizontal arm 80 that is pivotally mounted to a fixed support 82 for motion about a horizontal pivot axis 84. The drive housing 78, 80, together with the chuck and chuck housing mounted thereon, are reciprocally pivoted through 90°, from the solid to the dotted line positions shown in FIG. 2, by means of an air cylinder 83 pivotally connected at 85 to the support 82, and having an actuating piston 86 pivotally connected to the right angle drive housing. A motor 90 drives a right angle gear box 92 which, in turn, drives a pulley 94 journaled in lower arm 80. A belt 96, entrained over pulley 94, is also entrained over a second pulley 98 secured to the chuck shaft 70.

Figure 2:
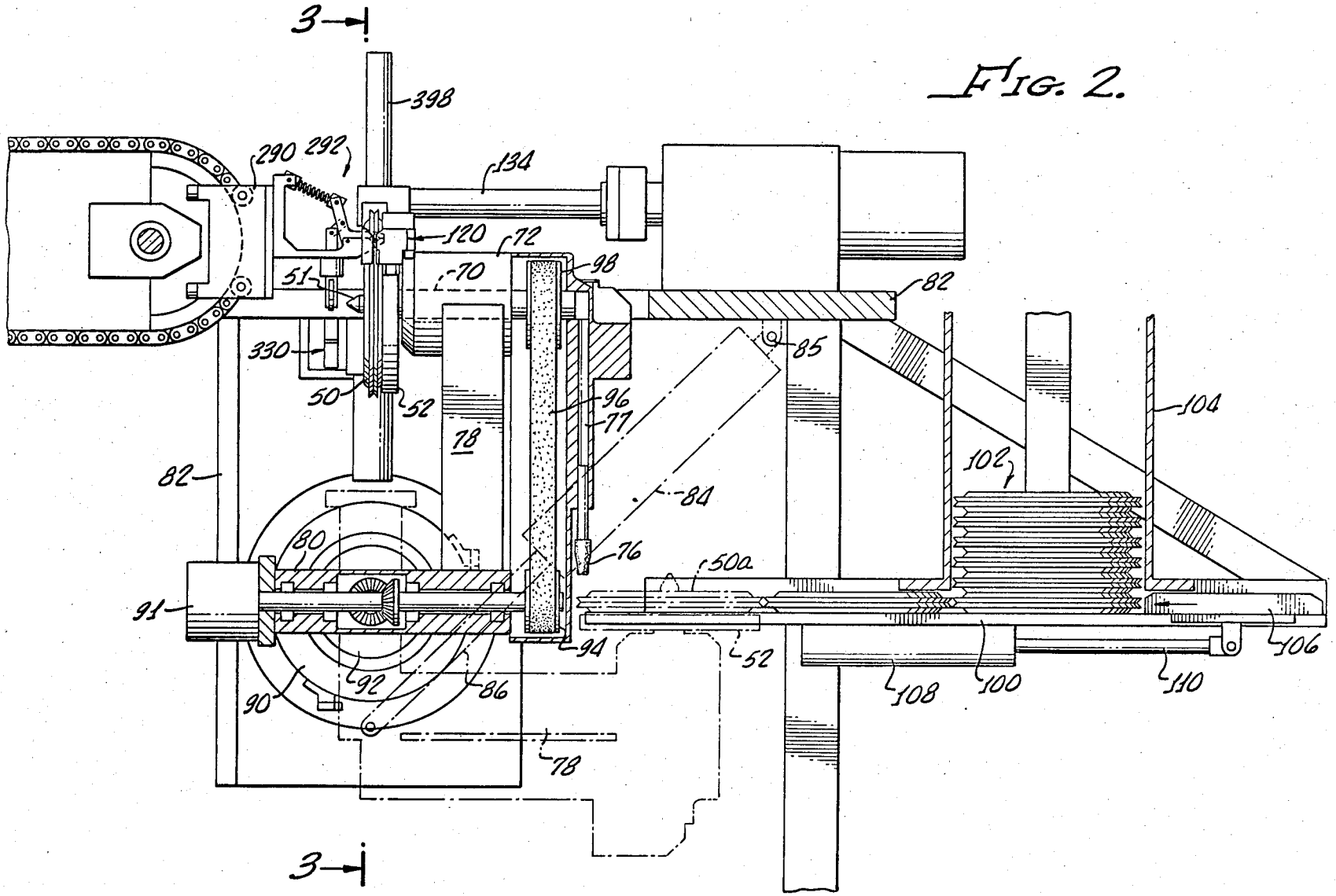
FIG. 2 is a sectional end view of the apparatus of FIG. 1 showing the rotatable chuck mounting in relation to a portion of the loaded reel conveyor.

For loading reels upon the chuck, the chuck and housing 72 are driven in a counterclockwise direction about the horizontal pivot axis 84, from the solid to the dotted line position of FIG. 2. In the latter position, the chuck face is horizontal and arranged to receive an additional reel 50*a* that is pushed along the upper surface of a magazine feed plate 100, from the bottom of a stack of reels 102 contained in a reel magazine 104. The lowermost reel of the stack 102 is pushed from the stack onto the horizontal chuck surface by means of a slideably-mounted push arm 106 that is reciprocated by an air motor 108 fixed to and below the magazine 100, and having an actuator piston rod 110 connected to the push rod 106.

In order to wind a length of wire cut to a predetermined length upon the reel, with both its leading and trailing edges projecting from the reel, chuck 52 is provided with a chuck clamp 120 (FIGS. 11–14) mounted at a rear side portion of the chuck for pivotal motion about an axis 122, under control of an air cylinder 124 pivoted at 126 to the chuck, and having an actuated piston 128 pivoted to the chuck clamp. The chuck clamp is mounted to swing between a load position, illustrated in FIGS. 11 and 12, wherein its grasping jaws lie in the plane of the reel and in a plane containing the path of the wire fed to the reel, and a retracted position (FIG. 13), in which the clamp jaws and a wire grasped therein are displaced from the plane of rotation of the reel. In retracted clamp position, the reel may continue to wind wire with reel, chuck and leading end of the wire all rotating together, but with the clamp and leading wire end displaced from the plane of wire rotation, so as to avoid interference with wire being fed to the rotating reel.

To initially load the leading edge of the wire onto the reel and into the chuck clamp, there is provided a load arm 130 (FIGS. 1 and 3), mounted for motion about a horizontal shaft 132, and carrying a clamp shaft 134 journaled in the arm about an axis parallel to the axis of shaft 132. A load clamp 136 is fixed to the arm 130. A chain 138 interconnects shaft 132 and 134 by means of pulleys or sprockets on the shaft to maintain the clamp 136 in the same vertically illustrated orientation throughout its travel. The load arm moves clamp 136 from the solid line position, shown in FIG. 3, to the dotted line position, where it is downstream of the chuck clamp 120 when the latter is in its load position.

Thus, the free end of a wire may be grasped by load clamp 136 and swung upwardly and forwardly to a position in alignment with the wire feed path, but beyond the reel and chuck clamp.

Figure 6:
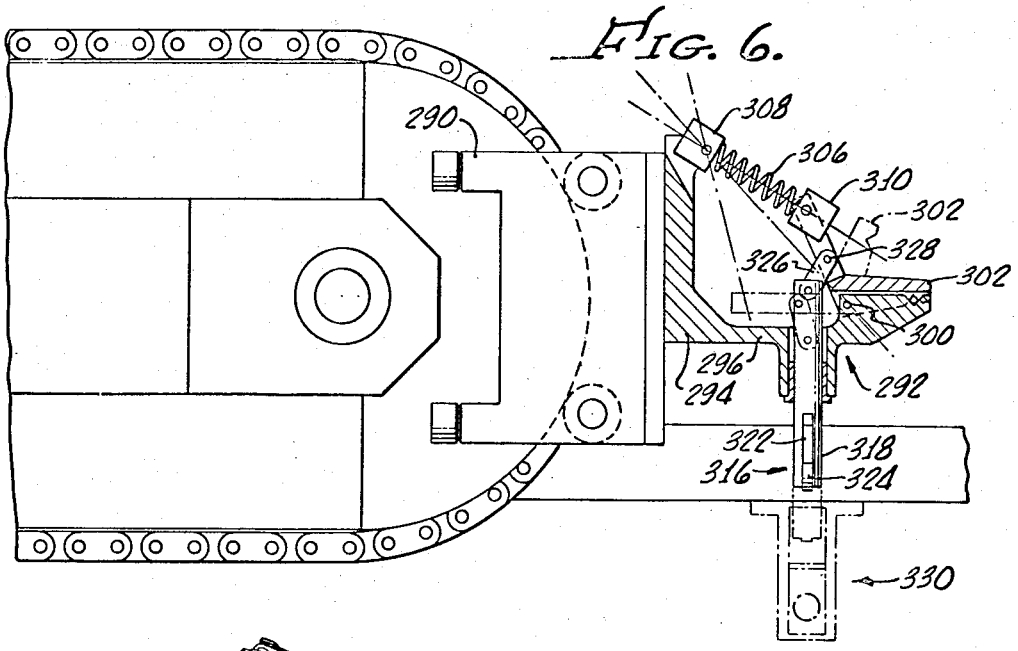
FIGS. 6, 7, and 8 show a typical transport clamp and its operation.

As illustrated in FIGS. 4, 5 and 6, each reel is composed of a pair of relatively light and resilient plastic side plates, secured together about a hub aperture 140, and extending radially outwardly to provide a relatively large closed hub section 142 by means of which the reel is vacuum-secured to the chuck face. The reel side plates are bowed outwardly, as at 146, and then bent inwardly, as at 148, to provide a necked down, peripheral, wire-receiving aperture 150 having outwardly flared entry flanges 152. A plurality of apertures 154, 156 are provided in the wire receiving reel chamber to ensure that any vacuum from the chuck does not cause sealing of the receiving aperture 150. Preferably, the aperture 150 is normally closed by the inherent resilience of the side plates, but is readily opened by pressure of a wire that is moved downwardly between the entry flanges 152. FIG. 4 illustrates the reel and wire, after completion of end processing, with terminals pins 157, 158 attached.

Figure 3:
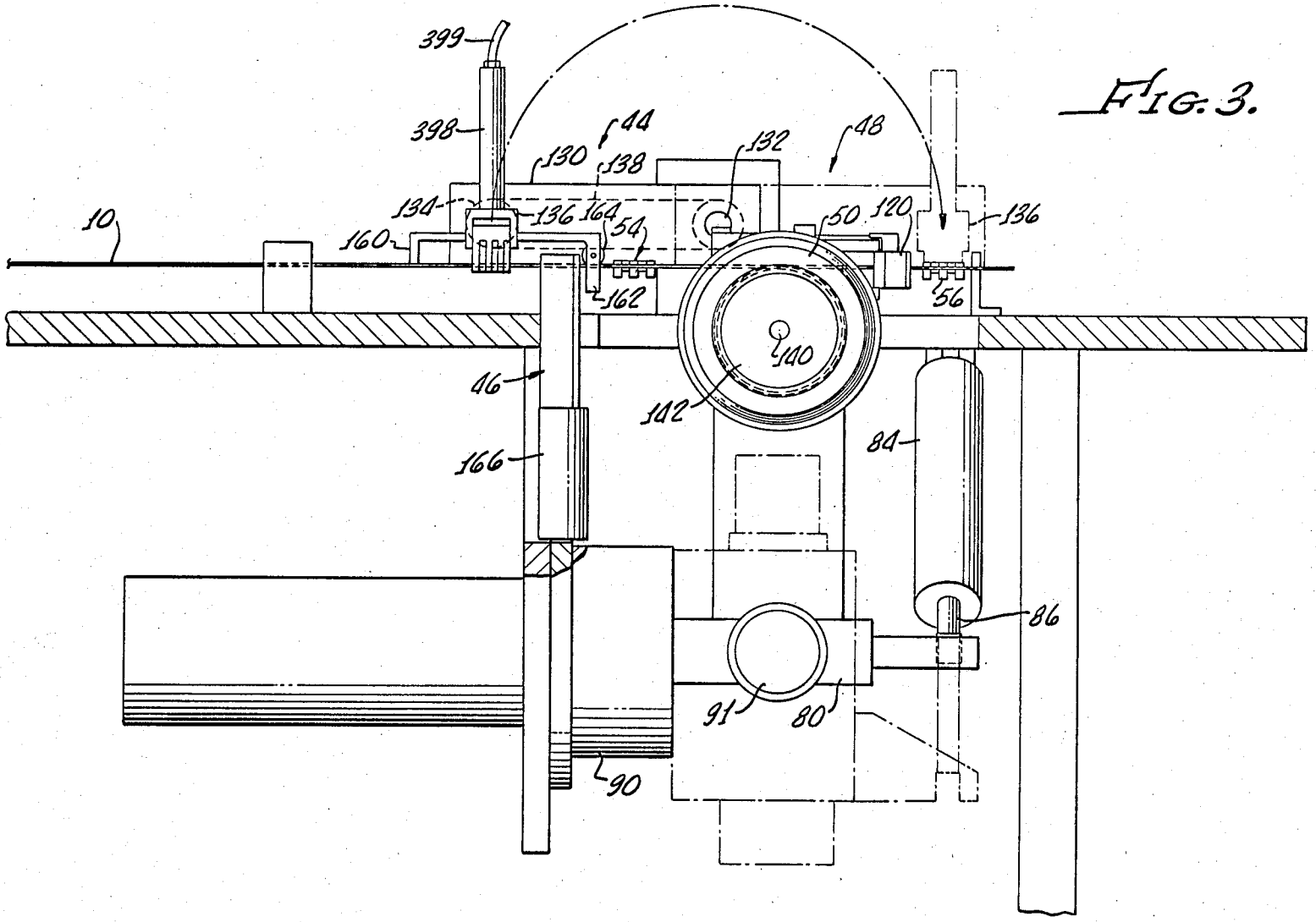
FIG. 3 is a sectional view showing the load arm and reel chuck.

In loading of the leading edge of the wire onto a reel that is vacuum secured to the chuck, load clamp 136 moves the leading edge of the wire upwardly, over the reel, and then forwardly and downwardly to reach the position illustrated in dotted lines in FIG. 3. As the clamp moves downwardly, the portion of the wire grasped by the load clamp that is to the rear of the clamp is pressed into the reel between the entry flanges 152, and is moved downwardly between the jaws of chuck clamp 120, which then close to grasp the leading edge of the wire. The wire is released from the load clamp, and the load arm 44 is then retracted to its initial or ready position, as shown in solid lines in FIG. 3. After retracting the chuck clamp to its winding position (FIG. 3) the chuck is driven to rotate the reel. Rotation of the reel, with the leading edge of the wire clamped to the chuck and thus fixed to the reel, pulls wire along its feed path from the slack loop 30 and over the cutter 46, which at this time is in retracted position. When the desired amount of wire has been wound upon the reel, rotation is stopped, the chuck clamp is moved to its load and unload position, and the load clamp 136 is actuated to grasp the wire.

It will be recalled that it is desired to have both leading and forward ends of the wire project in opposite directions and in substantial alignment with one another, as shown in FIG. 4 (which shows terminal pins attached). In the illustrated embodiment, this means that both leading and trailing edges of the projecting wire must be horizontal. However, the angular position at which chuck rotation is stopped depends not upon the angular position of the leading edge of the wire, but upon the length of wire that has been wound upon the reel. Accordingly, the chuck may stop its rotation with chuck clamp, and thus the leading edge of the wire, in a position other than the desired horizontal position. Therefore, after completion of chuck rotation, the chuck and reel are rotated in a reverse direction for a partial revolution sufficient to bring the chuck and leading edge of the wire back to the horizontal position illustrated in FIG. 3. The conveyor then is moved to position one pair of the transport clamps 54, 56 adjacent a takeoff position. The chuck clamp is returned to its load position, and outboard transport clamp 56 is actuated to grasp the leading end of the wire. The inboard transport clamp 54 is actuated to grasp the trailing end of the wire, and cutter 46 is operated to cut the end of the wire to the rear of transport clamp 54 and ahead of the load clamp 136 (while both of these clamps grasp the wire), leaving an end portion of the wound wire protruding outwardly (toward the left as seen in FIG. 3) from the transport clamp 54. Chuck clamp 120 now releases the wire and the conveyor commences its motion, having been stopped for the reel takeoff operation. As the conveyor is driven, the two transport clamps 54, 56 continue to grasp the outwardly protruding aligned ends of the wire, and thus support both wound wire and reel. The lower end of the reel may slide along the conveyor table 53. The clamps move the wire, together with the reel upon which the wire is wound, along the path of conveyor motion, moving the opposite ends of the outwardly projecting wire to the successive end finishing stations. The conveyor stops at each pair of opposed end finishing stations for appropriate operation of stripping or terminal connection, and the conveyor then continues to transport the reel and wire to its discharge end, at which point the transport clamps are actuated to release the reel.

Load arm 44 carries a pair of rearwardly and forwardly extending guides 160 and 162 (FIG. 3) to help position and align a wire grasped in the clamp 136. Forward guide 162 carries a roller 164 that presses down on the wire when the load clamp is in its ready position to ensure that the wire is properly positioned over the cutter 46. The latter includes a conventional mechanism driven by an actuator 166. After the wire has been completely wound upon the reel, and the two projecting ends of the wire grasped by the transport clamps, the load arm clamp and its guides are raised, so that as the near transport clamp 54 moves upwardly in its travel around the conveyor, the trailing edge of the wire, namely that portion extending between the trailing cut end and the transport clamp 54, is not bent by contact with the load arm guide roller.

SLACK LOOP CONTROL OF REEL AND WIRE DRIVE

The wire and reel drives are inherently asynchronous for a number of reasons. For any given speed of rotation of the reel, the rate of feeding of wire to the reel is nonlinear because of the varying diameter of successive turns, and the fact that one winding may slip over the previous one or have different positions with respect to the previous windings. The wire drive, which pulls wire from the supply past the marking station, will accommodate the requirements of the marker, which may entail stopping of the wire drive for each marking operation. Even if the wire drive is not stopped for marking, the speed of drive of the wire past the marker is not the same as the speed at which the reel, when driven at top speed, will pull wire from the slack loop 30. Thus, wire is fed by the wire drive, at an input rate, into the slack loop from a first work station, which may be the wire marker or the measuring station. A second work station is the reel that pulls wire from the slack loop, at an output rate, that is different than the input rate provided by the wire drive. Both the wire drive speed and the reel drive speed are controlled in coordination with one another by the slack loop. 30, so as to maintain a desired quantity of wire in the slack loop.

The reel drive is controlled by a position control that stops the reel drive when the amount of wire in the storage loop is a minimum. In addition, this position control reverses reel rotation, after the predetermined wire length has been wound on the reel, to bring the leading edge of the wire back to the horizontal position.

Control of wire length is achieved by providing a wire length measurement at a point upstream of the reel and upstream of the cutting mechanism, without providing any cut position identifying mark on the wire. To ensure appropriate type identification marking of the wire at desired locations, with respect to both ends of the wire, the wire drive and length measurement stations are positioned adjacent the wire marker. If a second measuring device were to be placed adjacent the cutter for accurate measurement of the cut point, it would be difficult to coordinate the two measuring devices, and discrepancies between the two might exist. Moreover, the physical arrangement precludes convenient location of a second measuring device adjacent the cutter. Thus, the system employs a measuring station 22, adjacent the marking and drive stations 26, 29 (FIG. 1), to keep track of a desired cut point, e.g., the point at which the wire will be cut when such cut point reaches the cutting station 46. The system uses only a measurement made at the measuring station 22. Cut point measurement is stored internally only, and is achieved without making any marks on the wire, such as a dent or other physical mark on the wire which would have to be sensed at the cutting mechanism location. Thus, neither measuring nor sensing devices are needed at the cutting station.

Figure 9:
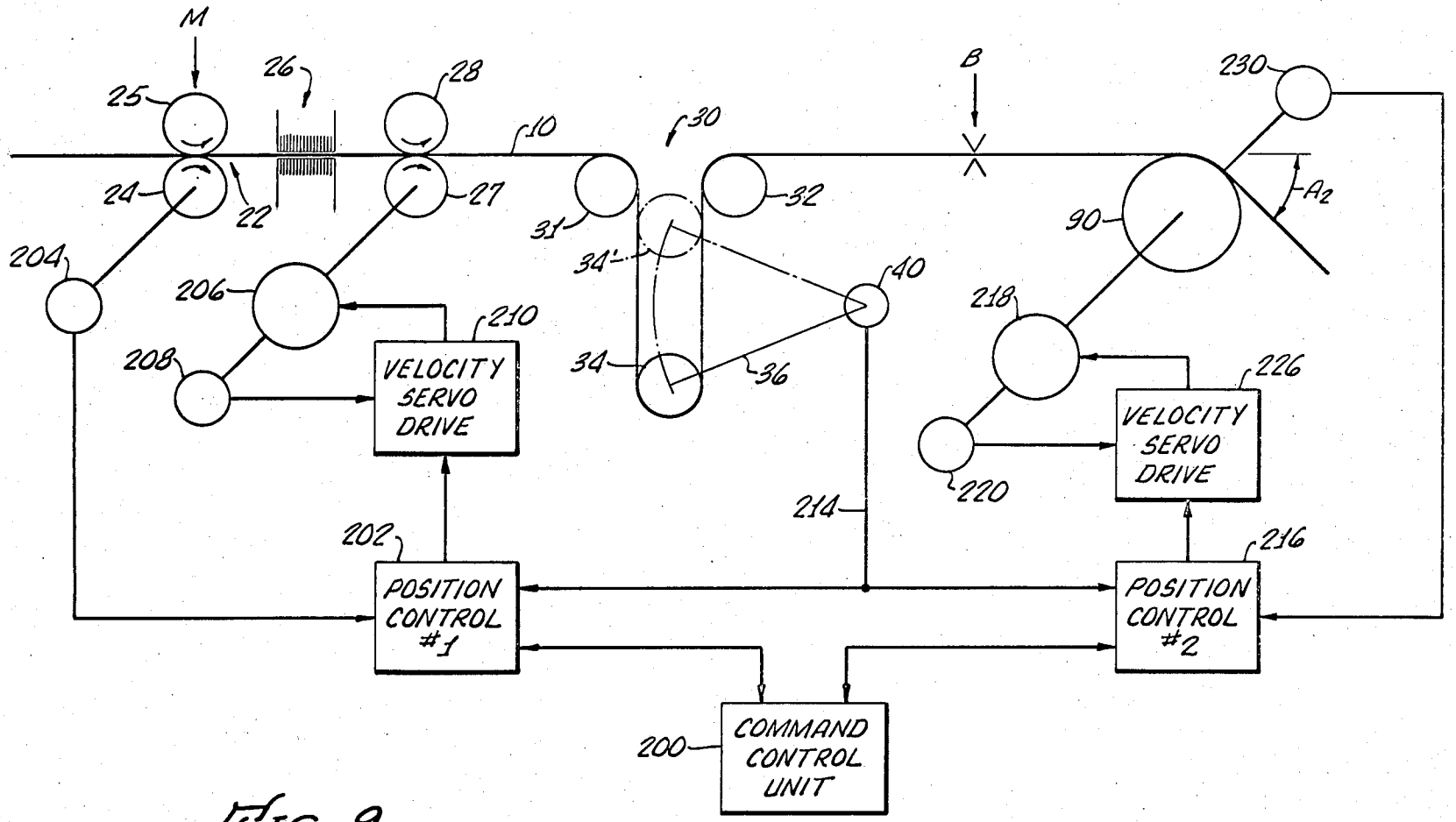
FIG. 9 is a block diagram of the control of the wire and reel drives from the slack loop.

Referring to the schematic illustration of FIG. 9, the system is arranged so that there is a known fixed distance between the measuring point M at station 22, and the blade B of the cutting mechanism when the slack loop arm 36 and pulley 34 are in their lowermost or minimum position, indicated in dotted lines in FIG. 9. Accordingly, wire is pulled past the measuring station 22 and into the slack loop by the wire drive, and withdrawn from the slack loop to be pulled past the blade B and wound upon the reel until the predetermined length has been measured at the measuring station, at which time the wire drive is stopped. After the wire drive is stopped, reel drive may continue to withdraw wire from the slack loop to be wound upon the reel until the slack loop reaches its minimum position. Upon occurrence of this second condition, the measured length of wire has been wound upon the reel, and reel drive is stopped. Thus, the winding of a predetermined length of wire on the reel has been completed, and reel drive is stopped upon occurrence of two conditions. The first condition is that the measuring station has measured passage of the predetermined length of wire. The second condition is that the slack loop is at its minimum position.

In the use of the slack loop, it is desired to feed wire into storage in the slack loop at the highest rate as possible. It is also desired to withdrawn wire by means of the reel rotation at as high a rate as possible. However, as the slack loop approaches its condition of maximum storage, the rate of input must be decreased, since a maximum input rate cannot be stopped instantly without significant overshoot. Similarly, as the amount of wire in the storage loop approaches the minimum storage condition, the rate of withdrawal must be slowed in order to avoid overshoot.

As indicated above, the wire measuring, marking and coiling system provides for conjoint, cooperative operation of the wire measuring and marking stations with the wire coiling station and its adjacent wire cutter. The unique operation of the coiling unit requires that the other devices be specially connected and controlled.

As previously mentioned, the coiling unit, comprising the reel and its chuck drive, clamp the leading end of the wire and wind it around the reel until the cut point (the unmarked point at which the trailing end of the wire is to be cut) is at the cutter blade. Load clamp 44 and transport clamp 54 grasp the wire ends adjacent the cut point just prior to cutting the wire. The coiling unit then reverses, typically through an angle of approximately 45°, until the leading wire end is horizontal and in line with the transport clamp 56 which then grasps the leading end. Wire slack resulting from the reel reversal is contained and confined within the reel. Thus, the transport clamps, gripping both ends of the wire, are able to move and position these wire ends for processing, including stripping and crimping or terminal attachment.

As illustrated in FIG. 9, the slack loop or storage station has its arm 36 connected to angle encoder 4 and will accommodate varying lengths of wire between the wire feed and coiling stations. In addition, the slack loop encoder provides information for speed control of both the wire drive and reel drive.

Wire marking can be performed while the wire is moving when ink jet or laser wire marking apparatus is employed. If a heated type wheel-marking marking apparatus is employed, then the wire must be stopped for marking. Neither the marking method or apparatus chosen, nor the speed of the wire, affects or changes system operation. In fact, the significance of coordinating wire drive and reel drive justifies the described system, even when marking is not employed.

Many applications require that the wire (generally an insulated electrical conductor) be marked with wire identifying indicia at a given distance from each end. Such distance may be denoted EL. Thus, when the first mark is made, the leading wire end (e.g., the point on the wire at which the first cut is to be made) is at a distance EL to the right (as viewed in FIG. 9) of the mark point M. At this time, the physical end of the wire has been threaded through the slack loop and past the transport clamp. The "leading wire end" is not yet a wire end, but is actually a point on the wire at which the first cut is to be made. After the cut has been made, this point on the wire will become the leading end of the first wire length.

Considering that the length of the wire path from the marking station M to the cut point B, through the slack loop when arm 36 and pulley 34 are in the minimum position, has a length CL, then it is known that a length of wire equal to CL must pass the measuring station to position the leading end at the cut point B, provided again that the slack loop is in its minimum position, and also provided that the measurement starts with the leading wire end at the measuring station.

A command control unit 200, storing the wire lengths and the lengths of end mark point, transmits these lengths to a wire drive position control 202 which receives a feedback input from an encoder 204 connected to one of the measuring wheels 24, 25, providing a signal indicating the actual length of wire that has passed the measuring station. Position control 202 is part of a conventional servo-positioning unit, connected to position each mark point or cut point under the marking head of the marking station 26. This servo-positioning unit includes a motor 206 connected to drive one of the drive wheels 27, 28, and having a velocity control loop including a tachometer 208, and velocity servo-drive 210 conventionally connected to receive an error signal from the position control 202. When each mark point is at the marking station, the marker is actuated, a signal is sent to the command control unit 200, and the next mark point is fed from the command control unit to the position control unit. The position control 202 includes a comparator or register (not shown) into which the command control unit sets a number denoting each distance to the next mark point or cut point. The number set into the register is decremented by the feedback signal from encoder 204. The resulting number contained in the register provides the servo error signal to the servo drive which thus stops the wire drive for each mark point and for each cut point. The cut length number from the command unit is provided with an identifying flag. Thus, when the register indicates a cut length distance has been decremented to zero, a signal is fed via the command control unit to a second position control 216 for the chuck and reel drive that will cause this position control to drive the reel in reverse to align the leading wire end. This reverses drive is not needed, nor used, when the wire drive stops solely for marking.

Maximum drive speed of the wire is made inversely proportional to the size of the slack loop. Thus, if the slack loop is at its maximum (arm 36 is at or near its solid-line position of FIG. 9) maximum wire drive speed is caused to be zero. Position of the slack loop arm 36 and pulley 34 are sensed by encoder 40 to feed back a storage magnitude signal on line 214 to position control 202 to vary the speed of wire drive.

As the wire is advanced for marking, the leading wire end is advancing toward the cutting station B. Position control 202 keeps track of the leading wire end position by algebraically combining the wire length feedback signal from encoder 204 with the last calculated position of the leading wire end. For example, initially, the leading wire end is at a distance CL from the cut point. At the time of the first marking, it is at the distance CL−EL from the cut point. As the wire continues to advance toward the cut point, the position of the leading wire end relative to the cut point is decreased by the amount of input from encoder 204, which signals the total amount of wire movement. When the measured wire motion approaches the value CL, the wire drive slows, and when the two are equal, wire drive is stopped. At this time, it is known that the leading wire end is at the cut point, provided that the storage loop is in its minimum condition. Upon attainment of each commanded wire position, the command control unit sets into the position control register the increment of distance to the next wire position; that is, a number denoting the distance from the present wire position to the next position, whether it be marking position or cutting position. This causes wire drive to resume.

While the pistion control 202 is controlling wire position for marking and cutting, the second conventional servo-positioning unit 216 is controlling the reel winding operation. Until the selected wire length has been measured at station 22 to stop the wire drive, the unit 216 operates solely as a velocity control. Speed of the reel drive is controlled to be directly proportional to the amount of wire stored in the slack loop. When pulley 34 and arm 36 are in the minimum slack loop position, the reel winding speed is caused to be zero. Encoder 40 provides a storage magnitude feedback signal to position control 216 for speed control via a motor 218, tachometer 220, and velocity servo-drive 226, connected to drive the chuck motor 90.

The dual rate control feedback from encoder 40 to both wire and reel drives ensures that the reel drive will continue until the wire drive has been stopped (by measurement of the selected wire length). If the storage magnitude approaches the minimum position (at which reel drive is stopped), the directly proportional reel drive speed decreases and the inversely proportional wire drive speed increases, thereby increasing the storage magnitude and avoiding cessation of reel drive until both the selected wire length has been measured and the storage magnitude has reached minimum. Should the reel drive stop with the wire drive stopped for marking, but not for cutting, the reel drive does not reverse, but merely starts again after wire drive resumes to increase the storage magnitude.

Position control 202 stops the wire drive when the length calculation is zero; that is, when the measured amount of wire has passed the measuring station. The slack loop is not yet at its minimum position. Therefore, position control 216 drives the chuck motor at decreasing speed as the amount of wire in the storage loop decreases, stopping chuck rotation when the storage loop reaches its minimum condition. At this instant, the wire end, that is, the point at which wire is to be cut, is under the cutting blade station B, and the external holding clamps are applied to the wire at both sides of the cut mark. Shortly thereafter, the wire is cut. An encoder 230, coupled with the chuck drive motor or chuck shaft, feeds back signals denoting rotational position of the reel to the position control 216 which, thus, keeps track and stores absolute shaft position (from zero to 359.9°) of the chuck spindle. After the minimum storage magnitude has been signaled to position control 216 from encoder 40, and the reel drive has stopped, the winding clamp on the chuck may be at some typical angle A2 relative to its desired position of alignment with the wire path. Encoder 230 is then used in the position feedback loop, comparing the encoder output with the known horizontal position of the chuck spindle to provide a position error signal that drives the reel in reverse, back to its horizontal position with the leading end of the wire aligned with the wire feed path. As mentioned above, the reverse drive occurs only after position control 202 has signaled that the desired length of wire has been measured and the wire drive stopped.

The command control and position controls are preferably operated under the control of a suitably programmed digital computer which may readily handle different wire lengths, including several successive wire lengths, each of which may be considerably less than the distance CL. Thus, the measuring and cutting stations may be spaced from one another along the wire path at a distance several times greater than the length of any selected wire that is to be cut and coiled.

In operation of the slack loop control, wire is first threaded through the wire path, past the measuring station 22, wire marker 26 and drive station 29, through the slack loop, past the loading arm clamp, and past the cutting station, where the wire is cut at the cutting station blade. Wire drive is started to pull wire from the supply spool past the wire marker to initiate wire measurement at the drive and measuring station 22. Before, or with the starting of the wire drive, the leading edge of the cut wire is grasped by the load arm clamp 136 and carried up and over a reel which is vacuum secured to the chuck. The wire end is grasped by the chuck clamp 120 which is aligned with the wire path, the load arm clamp releases the wire, and the load arm returns to its ready position. The chuck clamp and wire end are retracted, and both wire and reel drives are started. Preferably the wire drive is started first to ensure that the wire storage loop contains more than its minimum amount of wire. The wire drive feeds wire into the storage loop to allow the spring loaded arm 36 to move in a counterclockwise direction, as viewed in FIG. 9. At the same time, the reel drive pulls wire from the storage loop, tending to pull the arm 36 in a clockwise direction. Arm 36 moves to a position determined by the speeds of both the wire and reel drives. If the amount of wire in the storage loop is small, the wire drive speed is high, and the reel drive is decreased, having a value proportional to the amount of wire in storage. If the amount of wire in the storage loop is high, the reel drive speed is high, and the wire drive speed is low, having a value inversely proportional to the amount of wire in storage. During this period of operating both wire and reel drives, the wire drive may stop momentarily in one or more positions to facilitate operation of the wire marker. When a predetermined length of wire (to be cut) has been measured to the measuring station, the wire drive stops, and position control 202 signals the reel control unit 216. The reel drive continues, decreasing in speed as the amount of wire in storage decreases. When the storage arm reaches its position of minimum storage, the reel drive is stopped, the transport clamps are moved to position, and the inboard transport clamp grasps the wire to fix the length of wire wound on the reel. Now position control 216 will back up the reel to align the leading edge of the wire in its horizontal position where it may be grasped by the outer one of the transport clamps.

It will be readily appreciated that the described machine and method can rapidly handle wires of length varying from as short as several feet up to one or two hundred feet in length, depending only upon wire gauge and capacity of the reel and, moreover, can cut and prepare small quantities of wire pieces of varying length, even fabricating successive wire pieces of mutually different lengths, all without varying the size or extent of the apparatus. It is merely necessary to program or otherwise set different lengths in the command control unit.

An important feature of the described method and apparatus is the fact that the wire wound on reels may be more easily handled. For example, as illustrated in FIG. 18, a plurality of reels carrying end processed lengths of wire, prepared as described herein, may be stacked on a common vertical spindle 250, mounted on a carriage 260 that travels along a gantry 262 which, in turn, is mounted for transverse motion along tracks 264, 266 extending along a work table 268, upon which a wire harness is to be assembled. Multi-pin connectors 270, 272 are fixedly positioned in suitable holders at selected locations of the work table and guide pins 274 are mounted on the work table to guide the wires being assembled in the harness and to define the path of the wires. The first end of each wire, mounted on the reels of the stack of reels 252, is pulled from the reel and inserted into the first connector 270. Then the carriage 260 and the stack of reels thereon is moved along the desired path to pull out one wire from each of the reels so that wires are pulled from all reels simultaneously and positioned along the desired harness path, including the path shown in dotted lines at 276, until the second end of each wire is then removed from the reel and inserted into the second multiple-pin connector 272. Thus, instead of handling each length of wire individually, the coiling of the wires on the reel enables a much more precise and rapid method of harness assembly. Many other methods of harness assembly and wire handling are also facilitated by employing the described combination of wire and reel.

CLAMP STRUCTURES

Figure 7:
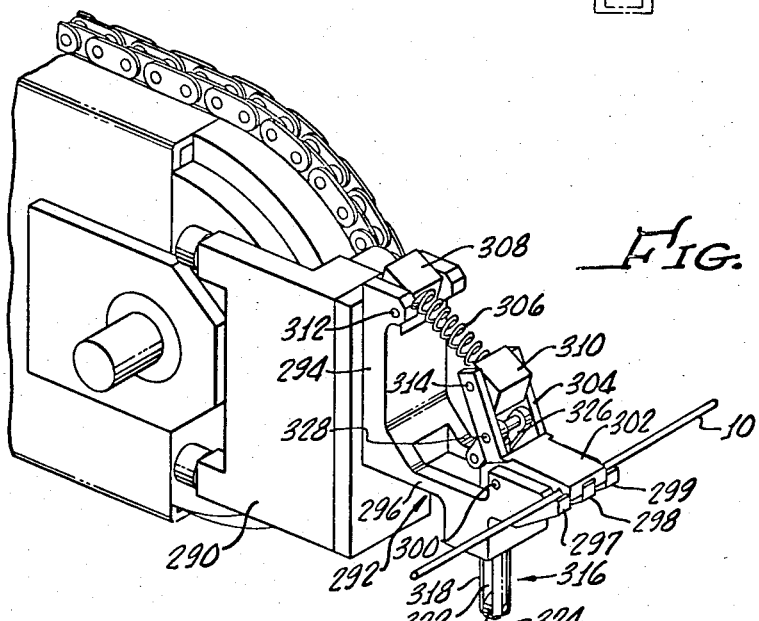
Figure 8:
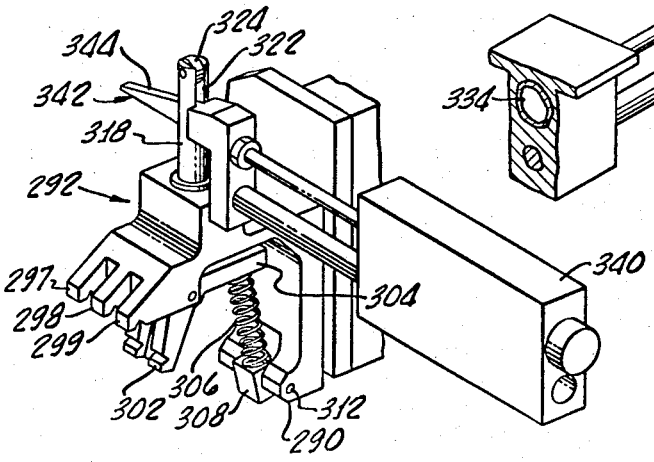

Illustrated in FIGS. 6, 7 and 8 are details of the transport clamps. Each clamp comprises a clamp base 290 fixed to a conveyor section and fixedly mounting a fixed clamp jaw 292, having a first arm 294 secured to the base 290 and a second arm 296 extending at right angles to the arm 294, and terminating in a plurality of fixed clamp fingers 297, 298, 299, each of which is formed with a wire-receiving groove. Pivoted to the fixed jaw 296, on a pivot pin 300, is a movable clamp jaw 302 having a fixed crank arm 304. A compression spring 306 is captured between first and second spring abutment blocks 308, 310 which are pivoted respectively to the fixed arm 294 of the fixed clamp jaw and to the crank arm 304 of the movable clamp jaw on axes 312, 314, respectively. A clamp actuator 316 is slideably mounted in, and extends downwardly from, the fixed clamp jaw (FIGS. 6, 7), and has a pair of mutually spaced arms 318, 320 forming an open-ended slot 322 therebetween that is closed by a roller 324, journaled at the end of the actuator arms. The upper end (as viewed in FIG. 7) of actuator 316 is pivotally connected to one end of a link 326 having its other end pivoted on an axis 328 to the crank arm 304. Thus, vertical sliding motion of actuator 316 will rotate the movable clamp jaw about the axis 300 between two over-center positions, both of which are maintained by action of the spring 306.

At each conveyor position, where a transport clamp is to be closed to grasp a wire end, is mounted a clamp closing cam 330 (there being one on each side of the conveyor for operation of the clamps on each side of the conveyor) having an inclined cam surface 322 (FIG. 7), and driven for linear reciprocation by an air motor 334 so as to move from a retracted position, in which the transport clamp is allowed to pass freely, to an extended actuating position wherein the cam 332 engages actuator roller 324 to drive the actuator 316 upwardly, and move the jaw 302 downwardly into wire clamp position. At a position where a transport clamp is to be opened to release a wire end, there is provided a similar air motor 340 (FIG. 8) driving a cam 342 for linear reciprocation into and out of the slot 322 in the actuator arm 316. Cam 342 has an inclined cam surface 344 (facing upwardly as seen in FIG. 8). This cam surface engages the actuator roller 324 when the cam 344 is driven outwardly to its extended position in which it enters the slot 322 to drive the actuator 316 upwardly (FIG. 8), thereby opening the transport clamp.

The chuck clamp body (FIGS. 10, 11, 12) is pivotally mounted for motion about the clamp swing axis 122 upon a clamp mounting bar 350 fixed to the chuck body. The clamp is driven between the load and unload position, illustrated in FIGS. 10 and 11, and the retracted position of FIG. 12 by means of air motor 124, 128. Motor actuator shaft 128 is connected to a swing bracket 352 fixed to the clamp body and pivoted to the air motor actuator 128 on an axis 354 that is spaced from clamp swing axis 122.

Figure 14:
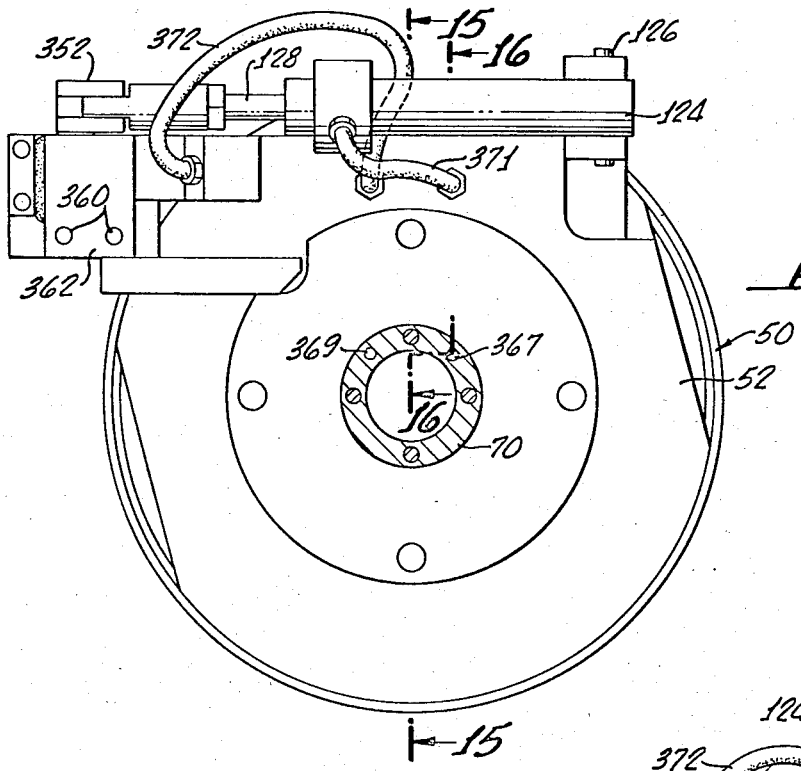
FIG. 14 is a sectional view across the hollow chuck shaft.
Figure 16:
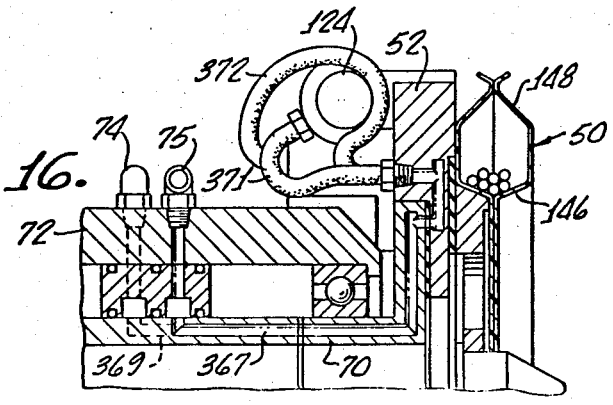

The chuck clamp includes a fixed body 356 (FIG. 13) to which the swing bracket 352 is fixed. A movable clamp jaw 358 carries a pair of slides 360 that are slideably guided in a lower portion of body 356 and fixedly connected to a reaction plate 362 on the other side of body 356. Interposed between reaction plate 362 and body 356 is an air inflatable bladder 364 which may be pressurized to drive the reaction plate 362 toward the right as viewed in FIG. 13, carrying the movable clamp jaw 358 toward the right and, thus, toward the clamp body, so that a wire positioned between the clamp body and clamp jaw 358 may be grasped by the clamp. A spring 359 encircles the slides 360 and is compressed between the clamp jaws so as to urge the jaws toward open position. The wire receiving ends of the clamp jaws are beveled, as illustrated at 368, 370, to guide a wire into the space between the open jaws. Air hose 372 is coupled to bladder 364 to control bladder pressure. As best shown in FIGS. 14, 15, and 16, pressurized air is independently fed to the clamp retraction motor 124, and to the clamp bladder 364, by means of fittings 74, 75 connecting with conduits 367, 369 extending longitudinally through the wall of hollow chuck shaft 70, and thence through the chuck body for connection to the clamp motor and clamp bladder via pressure hoses 371, 372.

The load arm clamp, as best seen in FIG. 17, comprises pairs of movable clamp jaws 380, 382, each having mutually overlapping offset portions 384, 386 pivoted to each other on a pin 388 fixed to clamp housing 389. A bridge arm 390 spans the upper ends of the two clamp jaws and is pivoted to each on pivot pins 392, 394 respectively. Bridge arm 390 is fixed to an actuator shaft 396 of an air motor 398 so that the clamp jaws, which are opened by a spring (not shown), will close when the bridge arm 390 is driven downwardly by downward motion of the cylinder actuator 396 which is driven by pressurized air supplied via a hose 399.

The conveyor arrangement illustrated in FIG. 1 enables end finishing of both ends of the wire as wire and reel are transported along the conveyor by employing end finishing machines on both sides of the conveyor. Such an arrangement is fast, but requires duplicate end processing machines on each side. The arrangement illustrated in FIGS. 19 and 20 allows both projecting ends of a wire wound upon a reel, as previously described, to be end processed by machines positioned at only one side of the conveyor. In this arrangement, conveyor chains 400, 402 fixedly carry respective ends of a bridging bar 404 extending across the fixedly positioned conveyor table 406. Table 406 extends along the length of the upper side of the conveyor between the two side chains and is slotted as at 408 to receive and cam a cam follower pin 410 that depend from a crank arm 412 pivoted to the bridging bar 404 on a shaft 414.

One end of the bridging bar 404 mounts a fixed transport clamp 420, while a second and identical transport clamp 422, for the opposite side of the conveyor, is fixed to the outer end of an angulated swinging arm 430 which has its innermost end fixed to the shaft 414 which is journaled in the bridging bar 404. Wire transport clamps 420, 422 are identical to the transport clamps previously described. A spring 432 on shaft 414 is connected between the clamp supporting arm 430 and the bridging bar 404 to urge the swinging clamp arm 430 in a counterclockwise direction to an aligned limiting position (illustrated in FIG. 19) against a stop 434 (see FIG. 20) on the bridging bar. In this position, the two clamps are mutually aligned and are positioned to grasp and unload a wound reel from the winding chuck. In this aligned positioned, the two clamps are also positioned to release the wire and reel after end processing has been completed.

After the aligned transport clamps have received and grasped the wire ends, and begin transport of the wire and reel along the conveyor, cam follower pin 410 engages the side 440 of a laterally inclined leg of cam slot 408 which rotates the crank 412 and swing arm 430 in a clockwise direction. The cam slot is arranged so that when the conveyor has moved to position the cam follower 410 in a subsequent straight longitudinally extending section 442 of the cam slot, the crank and swinging clamp arm have rotated 180° about the axis of shaft 414 to position the second clamp 422 on the side of the conveyor which carries the fixed clamp 420. The limiting position of the swing arm 430, in the course of its clockwise motion, is controlled by cam forced abutment of the clamp 422 against the clamp 420. Thus, the conveyor may be stopped at the first end finishing station after the clamp 422 has been swung to the processing side (FIG. 20), so that end 450 of the wire grasped in swinging clamp 422 may be processed. Thereafter, the conveyor is restarted until the end 452 of the wire grasped in clamp 420 is positioned at the same end processing station, at which time the conveyor is stopped for completion of the processing of the second end of the wire. During this forward motion, and during all motion between the reel loading and reel unloading position, the swinging clamp 422 is positioned on the same side of the conveyor as is the fixed clamp 420.

The various drives and motors, including electric and air motors, clamp actuators and vacuum and the like, all may be controlled in any manner desired, and in the described sequence to provide the described mode of operation. In a preferred embodiment, an electronic control system, which includes a suitably programmed digital controller 454 (FIG. 1) is provided to transmit appropriate control signals. Such a control system is arranged to enable the apparatus to cut and wind successive wires of different lengths, or short or long runs of wires of the same length. The apparatus will provide rapid, automatic assembly of coils of wire, each wound upon individual reels, each having a selected length, and each having both of its ends processed as desired.

The foregoing detailed description is to be clearly understood as given by way of illustration and example only, the spirit and scope of this invention being limited solely by the appended claims.

What is claimed is:

1. The method of feeding a predetermined length of elongated material to a work station comprising
withdrawing said material from a material supply station,
feeding said material from said supply station to a temporary storage station,
stopping withdrawal of material from the supply station when said predetermined length has been withdrawn,
withdrawing material from the storage station and feeding it to the work station, and
stopping withdrawal from the storage station when the amount of material in said storage station decreases to a predetermined amount.

2. The method of feeding a predetermined length of elongated material to a work station comprising
withdrawing said material from a material supply station,
feeding said material from said supply station to a temporary storage station,
stopping withdrawal of material from the supply station when said predetermined length has been withdrawn,
withdrawing material from the storage station and feeding it to the work station, and
stopping withdrawal from the storage station when the amount of material in said storage station decreases to a predetermined amount,
said supply station comprising a spool of wire, said work station comprising a reel upon which a predetermined length of wire from said spool is to be wound, and including the steps of increasing the rate of withdrawal of wire from the spool as the amount of wire in the storage station decreases and decreasing the rate of feeding wire to the reel as the amount of wire in the storage station decreases.

3. The method of claim 2 including the step of measuring the length of wire fed to the storage station, and cutting the wire adjacent the work station after occurrence of both (a) measurement of a predetermined length of wire fed to the storage station and (b) decrease of the amount of wire in the storage station to a predetermined amount.

4. The method of claim 1 wherein said steps of withdrawing material from said supply station and feeding material to said work station are performed at least partly at the same time but at different rates.

5. The method of feeding a predetermined length of elongated material to a work station comprising
withdrawing said material from a material supply station,
feeding said material from said supply station to a temporary storage station,
stopping withdrawal of material from the supply station when said predetermined length has been withdrawn,
withdrawing material from the storage station and feeding it to the work station, and
stopping withdrawal from the storage station when the amount of material in said storage station decreases to a predetermined amount,
said material being wire, and including the step of winding said wire on a reel at said work station, and cutting said wire adjacent said work station, whereby a predetermined length of wire may be wound upon said reel without placing any length indicia on the wire.

6. The method of feeding a predetermined length of elongated material to a work station comprising
withdrawing said material from a material supply station,
feeding said material from said supply station to a temporary storage station,
stopping withdrawal of material from the supply station with said predetermined length has been withdrawn,
withdrawing material from the storage station and feeding it to the work station, and
stopping withdrawal from the storage station when the amount of material in said storage station decreases to a predetermined amount,
including the step of feeding material to said storage station at a rate inversely proportional to the amount of material in said storage station.

7. The method of feeding a predetermined length of elongated material to a work station comprising
withdrawing said material from a material supply station,
feeding said material from said supply station to a temporary storage station,
stopping withdrawal of material from the supply station when said predetermined length has been withdrawn,
withdrawing material from the storage station and feeding it to the work station, and
stopping withdrawal from the storage station when the amount of material in said storage station decreases to a predetermined amount,
including the step of withdrawing material from the storage station at a rate proportional to the amount of material in said storage station.

8. The method of claim 7 including the step of feeding material to the storage station at a rate inversely proportional to the amount of material in said storage station.

9. The method of feeding a predetermined length of elongated material to a work station comprising
withdrawing said material from a material supply station,
feeding said material from said supply station to a temporary storage station,
stopping withdrawal of material from the supply station when said predetermined length has been withdrawn,
withdrawing material from the storage station and feeding it to the work station, and
stopping withdrawal from the storage station when the amount of material in said storage station decreases to a predetermined amount,
said supply station comprising a spool of wire, said work station comprising a reel upon which a predetermined length of wire from said spool is to be wound and including loading the wire on said reel with a leading end of the wire projecting from the reel, cutting a trailing end of the wire adjacent the reel after a predetermined length of wire has been wound upon the reel, and driving the reel in a reverse direction to align said leading and trailing ends.

10. The method of winding a predetermined length of elongated material upon a reel comprising the steps of withdrawing material from a supply station and feeding it into a storage station at an input rate, measuring the length of material fed into the storage station, connecting material from the storage station to a wind up reel, rotating the reel to withdraw material from the storage station at an output rate, causing said input rate to decrease as the actual amount of material in the storage station increases, decreasing the speed of rotation of said reel to decrease said output rate as the actual amount of material in the storage station decreases, stopping feeding of material into the storage station when a predetermined length of material has been measured, stopping withdrawal of material from the storage station and rotation of the reel when the amount of material in the storage station is at a predetermined amount, and cutting the material adjacent the reel after the reel rotation has stopped.

11. The method of elongated material end processing comprising winding a length of material on a reel with at least a first end of the material projecting from the reel, grasping the projecting material end in a clamp, cutting the material adjacent the reel to sever a length of material on the reel from material not yet wound on the reel, and moving the clamp to thereby transport the reel and material thereon to an end processing station to present said material end to said station while said length of material remains on said reel.

12. The method of claim 11 including the step of causing the other end of said length of material to project from said reel, grasping said other projecting end in a second clamp, at least partly supporting said reel from both said projecting ends, and transporting the reel to an end processing station by moving both said clamps.

13. The method of claim 11 wherein said winding includes the step of causing both ends of the material to project from the reel, and wherein said grasping includes grasping both ends of the material.

14. The method of claim 13 including the step of supporting the reel from both the projecting material ends for transport to an end processing station.

15. The method of claim 11 wherein said winding includes causing both ends of material wire to project from said reel in substantially opposite directions and beyond opposite sides of said reel.

16. Apparatus for handling elongated material of different lengths and processin at least one end of the material comprising, a reel, a length of elongated material wound on the reel one turn at a time, said material having first and second ends protruding from said reel, and means on said reel for holding said material ends in a position in which they each protrude from the reel.

17. A system for processing ends of elongted material comprising a conveyor, means coupled with the conveyor for driving the conveyor in a first direction, an end processing station adjacent the conveyor, a pair of clamps on said conveyor mutually spaced in a second direction angulated with respect to said first detection, whereby at least one of said clamps passes near said station as the conveyor is driven, a reel for holding a length of elongated material of which at least one end is to be processed by said station, and means for coupling said reel to and between said clamps, said means for coupling comprising a length of material wound upon said reel and having opposite material end portions projecting from the reel to said clamps, said material end portions being respectively clamped in the clamps, whereby said reel and a material end portion are transported to said station for processing of said material end portion at said station.

18. The method of loading a length of elongated material upon a movable conveyor for transport to an end processing station at which an end of said material is processed, comprising positioning a portion of elongated material across a reel with a forward end of the material projecting from the reel, rotating the reel and said projecting material end to wind a length of said material on said reel with said forward material end projecting from said reel and a rear unwound portion of said material projecting from said reel, grasping the rear projecting material portion in a first clamp grasping the forward projecting material end in a second clamp, and cutting the material rearwardly of said first clamp, whereby said clamps can transport said reel and the material wound thereon.

19. The method of claim 18 including the step of reversely rotating the reel after grasping by one of said clamps and before grasping by the other of said clamps so as to position one of said projecting ends in alignment with the other of said projecting ends for grasping by said other clamp.

20. Apparatus for winding a selected length of elongated material on a reel comprising a support, means on the support for feeding elongated material along a material feed path, a rotatable chuck mounted on the support adjacent said path, a reel, means for releasably mounting the reel on the chuck and in said path, a chuck clamp, means for mounting the clamp to the chuck for motion relative to the chuck between a reel load position wherein the clamp is aligned in said path to receive a forward portion of material to be wound on the reel, and a retracted position wherein the clamp is displaced from said path and clears material being fed for winding upon the reel as the reel rotates, and means on the support for rotating the chuck.

21. The apparatus of claim 20 including a load arm having a load clamp for grasping material in said feed path rearwardly of said chuck, and means for mounting the load arm to the support for motion between a load start position wherein the load clamp is to the rear of said chuck and a load chuck position wherein said load clamp is adjacent said chuck clamp when the chuck clamp is in its reel load position.

22. The apparatus of claim 21 including a conveyor, first and second transport clamps mounted on said conveyor for motion with the conveyor along first and second transport paths adjacent to and on opposite sides of said reel, said first transport path passing between said reel and said load clamp when in load start position, whereby the first clamp may grasp a rear portion of material projecting rearwardly from the reel, said second transport path passing adjacent said chuck clamp in reel load position, whereby the second transport clamp may, grasp a forward portion of material projecting forwardly from the reel, and means on the support for operating said clamps, to grasp and release material whereby material ends projecting from said reel may be grasped by the transport clamps and the material may be released from the load and chuck clamps for transport of the reel and the material thereon by said conveyor.

23. The apparatus of claim 20 including a material supply station, a measuring station, a drive station including drive means for withdrawing material from the supply station past the measuring station and along said feed path to said chuck, said stations and drive means being mounted on said support, a slack loop on said support in said feed path between said drive station and said reel, said slack loop including means for storing a variable length of material and means operatively associated with said drive means and responsive to the length of material stored in said slack loop for controlling both said drive means and said chuck rotating means.

24. The apparatus of claim 23 including means on the support for stopping rotation of said chuck when a predetermined amount of material has been measured at said measuring station and when a predetermined minimum length of material is stored in said slack loop.

25. The apparatus of claim 23 wherein said means for controlling comprises means responsive to said slack loop and coupled with said drive means for decreasing speed of said drive means as the length of material in said loop increases, and means for decreasing speed of said chuck rotating means as the length of material in said slack loop decreases.

26. Apparatus for winding a predetermined length of elongated material upon a reel comprising a support, a material supply spool on said support, material storage means on said support, material drive means on said support for withdrawing material from the spool and feeding it into the storage means, measuring means on said support for measuring the length of material fed into the storage means, a chuck on said support for mounting a reel upon which material is to be wound, reel drive means on said support for rotating said chuck, storage detector means on said support for sensing the amount of material stored in said storage means, and means on said support responsive to said storage detector means for controlling the speed of both said material drive means and said reel drive means.

27. The apparatus of claim 26 including means on said support for stopping said reel drive means when a predetermined length of material has been fed into said storage means and the amount of material in said storage means is a predetermined minimum.

28. The apparatus of claim 26 including a chuck clamp, means on the chuck for mounting the clamp to the chuck for motion relative to the chuck between a reel load position wherein the clamp is aligned to receive a forward portion of material to be wound on the reel and a retracted position displaced from the plane of material being wound upon the reel.

29. The apparatus of claim 26 including chuck clamp means on said chuck for grasping a forward end of material to be wound upon a reel carried by the chuck, means on said support for clamping a trailing end of a length of material after it has been wound upon a reel carried by the chuck, and means on said support for rotating the reel relative to said trailing material end to align a leading end of material wound upon the reel with the trailing end of the material.

30. The apparatus of claim 29 including a reel magazine on said support for storing a number of reels, means for mounting the chuck on said support for motion from a loading position wherein the chuck is positioned to receive a reel from the magazine and a winding position in which the chuck is positioned to hold a reel thereon for winding of a wire drawn from said storage means.

31. The apparatus of claim 30 including wire load means mounted adjacent said chuck for grasping a forward end of a wire withdrawn from said storage means and threading such wire on a reel carried by said chuck.

32. The apparatus of claim 31 wherein said wire load means comprises a load arm mounted for motion between a first position at one side of the chuck and a second position at an opposite side of the chuck, said arm including load clamp means for grasping a wire, and means for displacing said chuck clamp means from the plane of rotation of a reel carried by said chuck.

33. The apparatus of claim 29 wherein said leading and trailing material ends extend in mutually opposite directions, and including a conveyor, first and second transport clamps mounted on said conveyor for motion with the conveyor along first and second transport paths adjacent to and on opposite sides of said chuck, and means connected with the conveyor for operating said transport clamps to grasp said leading and trailing ends of material wound upon a reel carried by the chuck.

34. The method of fabricating a harness composed of first and second multiple terminal connectors interconnected by a number of lengths of elongated material that extend along a preselected route between the connectors, said method comprising mounting first and second connectors on a work table, positioning routing pins on the work table for guiding elongated material in a selected path between the connectors, winding each of a plurality of lengths of elongated material upon respectively individual ones of a plurality of reels, mounting the reels on a mobile carrier, inserting a first end of each of said lengths of elongated material into said first connector, moving said carrier and reels relative to said work table and toward said second connector to thereby withdraw each length of elongated material from its reel as the carrier and reels are moved, positioning the withdrawn lengths of elongated material at the routing pins as the carrier is moved to route the lengths of elongated material in said path toward said second connector, and inserting second ends of said lengths of elongated material into said second connector.

35. In a system for processing elongated material, wherein both end portions of a precut length of elongated material are transported along a conveyor in transport clamps to end finishing stations for end finishing operations on the material, the improvement comprising means for mounting one of the transport clamps on the conveyor for motion between a first position at one side of the conveyor and a second position at the other side of the conveyor, so that said one transport clamp may present an end portion of a length of material clamped therein to an end finishing machine on the same side of the conveyor at which the other end of the length of material is clamped.

36. The apparatus of claim 35 wherein said means for mounting said one clamp comprises a first arm fixed to the conveyor for motion therewith and a second arm pivoted to said first arm to swing said one transport clamp from one side of the conveyor to the other.

37. An end processing system for elongated material comprising a conveyor having first and second mutually spaced driving chains, a plurality of pairs of first and second clamps spaced along the length of said chains, means for mounting said clamps to said chains, means on the conveyor for actuating said clamps to receive and grasp opposite ends of a length of elongated material positioned in the clamps, an end processing station positioned adjacent said first chain and at a first side of said conveyor, means connected to the conveyor for driving said chains to position one clamp of each pair at said station, said means for mounting said clamps to said chains comprising, means for fixing the first clamp of at least one pair to said first chain, a transversely extending support arm fixed to said chains, a swinging arm pivoted to said support arm, the second clamp of said one pair being mounted to said swinging arm, and means on the conveyor for pivoting said swinging arm between a first position in which said second clamp is positioned at said second conveyor chain and a second position in which said second clamp is positioned at said first conveyor chain, whereby said second clamp may be pivotally moved to present material grasped thereby to the work station at said first side of the conveyor.

38. In combination a reel having first and second side members fixed to each other to form a reel hub, said side members cooperating with each other to form a wire receiving cavity circumscribing said hub, said side members having outer peripheral portions pressed against each other to close said cavity, and a length of elongated material on said reel, said material having an intermediate portion wound around said reel hub in said cavity and having first and second end portions projecting to the exterior of said reel from said cavity and between said outer peripheral portions, said end portions being clamped between said outer peripheral portions, whereby said elongated material is secured on said reel with both of its end portions held by the reel but projecting therefrom.

39. The apparatus of claim 38 wherein both said end portions project from said reel at mutually adjacent areas of said outer peripheral portions.

40. The method of handling elongated material of different lengths and processing at least one end of the material, comprising the steps of securing one end of the material to a reel in a position such that one end of the material protrudes from the reel, rotating the reel and the secured material end to wind the material on the reel, cutting a length of the material that is wound upon the reel at a portion thereof that protrudes from the reel to form a second end of material protruding from the reel, and securing said second end of material to the reel so that both ends of the length of material wound upon the reel protrude from the reel and are secured thereto.

41. Apparatus for handling elongated material of different lengths and processing both ends of the material comprising, a reel, including first and second side plates secured to each other to form a reel hub and a material receiving chamber therebetween, said side plates extending radially outwardly and having outer peripheries pressed against one another, a length of elongated material wound on the reel, said material having first and second ends protruding from said reel, said material ends each extending between the side plate outer peripheries and being pressed therebetween, and means on said reel for holding said material ends in a position in which they each protrude from the reel.

* * * * *